US005302181A

United States Patent [19]

Morichika et al.

[11] Patent Number: 5,302,181

[45] Date of Patent: Apr. 12, 1994

[54] OXIDE-DISPERSION-STRENGTHENED HEAT-RESISTANT CHROMIUM-BASED SINTERED ALLOY

[75] Inventors: Toshiaki Morichika, Hirakata; Takashi Onishi, Suita; Hiroshi Yamamoto; Koichi Yanai, both of Osaka; Hiroyuki Araragi, Hirakata, all of Japan

[73] Assignee: Kubota Corporation, Osaka, Japan

[21] Appl. No.: 868,191

[22] Filed: Apr. 14, 1992

[30] Foreign Application Priority Data

Apr. 26, 1991 [JP] Japan ..... 3-097000

[51] Int. Cl.[5] ..... B22F 9/00; C22C 29/12

[52] U.S. Cl. ..... 75/245; 75/235; 420/428; 419/32

[58] Field of Search ..... 75/235, 245; 420/428

[56] References Cited

U.S. PATENT DOCUMENTS

| | | | |
|---|---|---|---|
| 2,955,937 | 10/1960 | McGurty et al. | 420/428 |
| 3,591,362 | 7/1971 | Benjamin | 428/570 |
| 3,728,088 | 4/1973 | Benjamin | 75/233 |
| 3,841,847 | 10/1974 | Jones et al. | 420/428 |
| 3,992,161 | 11/1976 | Cairns et al. | 29/182.5 |
| 3,994,430 | 11/1976 | Cusano et al. | 228/122 |
| 4,915,899 | 4/1990 | Oliver et al. | 419/8 |
| 4,950,327 | 8/1990 | Eck et al. | 75/232 |
| 4,963,200 | 10/1990 | Okuda et al. | 148/325 |

FOREIGN PATENT DOCUMENTS

| | | |
|---|---|---|
| 2-258946 | 10/1990 | Japan . |
| 8805830 | 8/1988 | PCT Int'l Appl. . |
| 1211267 | 11/1970 | United Kingdom . |

OTHER PUBLICATIONS

Patent Abstrat of Japan, vol. 15, No. 7, Oct. 19, 1990, JP2258946.

*The Superalloys*, 1972, Ed. C. T. Sims, pp. 175–197 William D. Klopp, "Chromium-Base Alloys".

*Primary Examiner*—Peter A. Nelson
*Assistant Examiner*—Ngoclan T. Mai
*Attorney, Agent, or Firm*—Armstrong, Westerman, Hattori, McLeland & Naughton

[57] ABSTRACT

An oxide-dispersion-strengthened sintered alloy improved in oxidation resistance and compressive strength for use at high temperatures of at least 1350° C. The alloy includes a matrix of a metal consisting substantially or predominantly of Cr, and 0.2 to 2.0% by weight of $Y_2O_3$ uniformly dispersed in the matrix. The $Y_2O_3$ as uniformly dispersed is up to 0.1 μm in mean particle size.

2 Claims, 1 Drawing Sheet

OXIDE-DISPERSION-STRENGTHENED HEAT-RESISTANT CHROMIUM-BASED SINTERED ALLOY

FIELD OF INDUSTRIAL APPLICATION

The present invention relates to sintered alloys which possess excellent oxidation resistance and high-temperature compressive strength, and more particularly to an oxide-dispersion-strengthened heat-resistant sintered alloy which comprises $Y_2O_3$ finely dispersed in a matrix of a metal consisting substantially or predominantly of Cr.

BACKGROUND OF THE INVENTION

In furnaces of the walking beam conveyor type for heating steel materials such as slabs and billets, skid buttons arranged on skid beams serving as movable beams and fixed beams are repeatedly loaded with the steel material (the material to be heated) at a high temperature, so that heat-resistant alloys, sintered ceramic materials or composite materials of alloy and ceramic are conventionally used for making the skid buttons.

However, use of these materials involves problems. The heat-resistant alloy is not fully satisfactory in high-temperature strength, while the sintered ceramic material is brittle and low in toughness. The alloy-ceramic composite material undergoes degradation due to a reaction between the two component materials when used in a high-temperature environment. To overcome the problems, the present applicant has already proposed a sintered body of Fe-Cr alloy particles and a sintered body of Fe-Cr alloy particles and a particulate oxide of rare-earth element (Unexamined Japanese Patent Publications HEI 2-258946, HEI 2-258947, etc.). These bodies are prepared from an alloy powder or a mixture of alloy powder and particulate oxide of rare-earth element by a desired sintering process.

These sintered bodies are more excellent in oxidation resistance and high-temperature compressive strength than heat-resistant alloys, sintered ceramic materials and alloy-ceramic composite materials, but still remain to be improved in oxidation resistance and high-temperature compressive strength for use in operations which are conducted generally at higher temperatures of at least 1350° C. in recent years. It is therefore desired to provide materials having still higher oxidation resistance and more excellent high-temperature compressive strength.

We have directed attention to techniques of the so-called mechanical alloying process wherein a metal powder and an oxide powder are mixed together to finely disperse the particulate oxide in the state of a solid phase. The oxide-dispersion-strengthened alloys heretofore prepared by the mechanical alloying process are limited to Fe-based alloys and Ni-based alloys, which nevertheless have a drawback. The former alloys are not fully satisfactory in oxide resistance at high temperatures of not lower than 1350° C., while the latter alloys are insufficient in compressive strength at high temperatures of at least 1350° C. Thus, the materials heretofore present are not excellent in both the characteristics of oxidation resistance and compressive strength.

An object of the present invention is to provide a sintered alloy which has outstanding oxidation resistance and compressive strength at high temperatures of not lower than 1350° C. and which is very suitable for use as a material for skid buttons, and a powder for preparing the sintered alloy.

SUMMARY OF THE INVENTION

The sintered alloy of the present invention comprises 0.2 to 2.0% (by weight, the same as hereinafter) of $Y_2O_3$ having a mean particle size of up to 0.1 μm and finely dispersed in a matrix of a metal by the mechanical alloying process, the metal being (a) a metal consisting substantially of Cr, or (b) a metal comprising more than 0% to up to 20% of Fe, and the balance substantially Cr, or (c) a metal comprising at least one member selected from the group consisting of Al, Mo, W, Nb, Ta, Hf and Al-Ti in a total amount of more than 0% to up to 10%, and the balance substantially Cr, or (d) a metal comprising 0.1 to 2.0% of Ti, and the balance substantially Cr, or (e) a metal comprising more than 0% to up to 20% of Fe, at least one member selected from the group consisting of Al, Mo, W, Nb, Ta, Hf and Al-Ti in a total amount of more than 0% to up to 10%, and the balance substantially Cr, or (f) a metal comprising more than 0% to up to 20% of Fe, 0.1 to 2.0% of Ti, and the balance substantially Cr, or (g) a metal comprising more than 0% to up to 20% of Fe, 0.1 to 2.0% of Ti, at least one member selected from the group consisting of Al, Mo, W, Nb, Ta, Hf and Al-Ti in a total amount of more than 0% to up to 10%, and the balance substantially Cr.

The expression "finely dispersed" as used herein and in the appended claims refers to the state in which $Y_2O_3$ particles, which are presumably up to about 0.1 μm in mean particle size, are generally uniformly dispersed in the matrix of metal consisting substantially or predominantly of Cr, such as Fe-Cr alloy or Al-Fe-Cr alloy. The mean particle size of $Y_2O_3$ is a "presumed" value because when the particulate $Y_2O_3$ was checked for size under a scanning electron microscope at a magnification of ×10,000, it was almost impossible to identify $Y_2O_3$ particles at this magnification.

Incidentally, the sintered alloy, i.e., Fe-Cr alloy, the present applicant has proposed in the foregoing publication HEI 2-258946 comprises 5 to 80 wt. % of a particulate oxide of rare-earth element and 5 to 50 wt. % of Fe, whereas the particulate oxide of rare-earth element present in this alloy is about 2 μm in particle size and is to be manifestly distinguished from the particulate oxide as "finely dispersed" in the matrix according to the present invention.

DETAILED DESCRIPTION OF THE DRAWINGS

Figure 1:
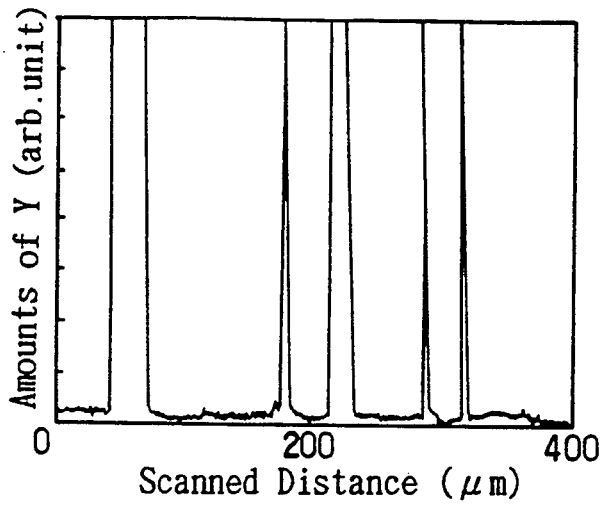
FIGS. 1 to 3 are diagrams obtained by subjecting specimens to EPMA (Electron Probe Microanalysis) to show $Y_2O_3$ as dispersed in a matrix.

As previously stated, the sintered alloy of the present invention comprises the oxide $Y_2O_3$ finely dispersed in a matrix of a metal consisting substanially or predominantly of Cr.

The alloy contains 0.2 to 2.0% of $Y_2O_3$ because if the $Y_2O_3$ content is less than 0.2%, the $Y_2O_3$ fails to give improved strength to the alloy, and further because $Y_2O_3$ contents in excess of 2.0% render the oxide liable to agglomeration during use at high temperatures of higher than 1350° C., with the result that coarse $Y_2O_3$ particles are formed to impair the effect of fine dispersal.

The matrix is formed by a metal consisting substantially or predominantly of Cr since the predominant presence of Cr is indispensable in obtaining the desired oxidation resistance and high-temperature compressive strength for use at temperatures not lower than 1350° C.

When the matrix metal consists substantially of Cr (and is free from any Fe), the alloy is very excellent in oxidation resistance and compressive strength, whereas the composition then has the drawback of becoming hard to sinter. The presence of Fe affords improved sinterability. However, an excess of Fe leads to formation of eutectic $Y_2O_3$-FeO having a lower melting point which results in reduced oxidation resistance. For this reason, the amount of Fe to be added to give improved sinterability should not exceed 20%. Whether Fe is to be incorporated into the matrix metal is determined suitably as required.

When required, at least one member selected from the group consisting of Al, Mo, W, Nb, Hf, Ta and Al-Ti can be further incorporated into the metal. Al, Nb and Ta precipitate in the matrix, and Mo, W, HF and Al-Ti form a solid solution in the matrix, whereby the matrix metal can be strengthened more effectively. However, the presence of an excess of such a metal will impair the high oxidation resistance afforded by Cr, so that the total amount of such additional metals is to be limited to 10% if greatest. The Al-Ti is an intermetallic compound.

Ti can be further incorporated into the matrix metal in an amount of 0.1 to 2.0% when required. Presence of Ti in the specified amount permits the $Y_2O_3$ to be finely dispersed in the matrix more effectively and uniformly. Ti differs from the above-mentioned Al-Ti in that the latter is present as an intermetallic compound for strengthening the matrix metal.

Some of Fe, Al, Mo, W, Nb, Hf, Ta, Al-Ti and Ti can be incorporated into the matrix metal in a desired combination.

The metal may contain up to 3% of Si and up to 3% of Mn as impurities since presence of such amounts of impurities will not produce any noticeable fault in respect of the properties of the alloy.

The sintered alloy of the present invention can be prepared by treating a mixture of material powder and $Y_2O_3$ powder by mechanical alloying and subjecting the resulting powder to a high-temperature compression treatment. When the matrix metal is free from Fe, a powder of simple metal Cr is used as the material powder. When the matrix metal contains Fe, the material powder to be used is a powder of Fe-Cr alloy, or a mixture of at least two of powder of simple metal Cr, powder of simple metal Fe and powder of Fe-Cr alloy.

When additional elements such as Al and Mo are to be used, the material powder to be used further comprises powders of such simple metals or a powder of corresponding alloys.

The mixture of material powder and $Y_2O_3$ powder is subjected to the mechanical alloying treatment using a high-energy ball mill such as an attritor to obtain a powder wherein the $Y_2O_3$ is forcibly finely dispersed in a solid state in the Cr or Fe-Cr alloy.

In view of the treatment with the attritor, it is desirable to use a material powder which is about 100 μm in mean particle size and a $Y_2O_3$ powder which is about 1 μm in particle size.

The high-temperature compression treatment can be carried out by hot pressing, hot isostatic pressing (HIP), hot powder extrusion or like known sintering process. It is desirable to resort to hot isostatic pressing.

For this treatment, the powder resulting from the mechanical alloying is filled into a suitable metal capsule, the capsule is closed after evacuation, and the powder is maintained at a temperature of about 1,000° to about 1,300° C. under a pressure of about 1,000 to about 2,000 kgf/cm$^2$ for a suitable period of time (e.g., for 2 to 4 hours). After the completion of being sintered, the product is cooled slowly over a period of about 20 to 30 hours.

When required, the sintered product can be subjected to a specified heat treatment.

Next, the relationship between the finely dispersed $Y_2O_3$ and the high-temperature compressive deformation resistance will be described with reference to the following example.

EXAMPLE

First, a powder of Fe-Cr alloy containing 15% of Fe and having a mean particle size of 100 μm, and a powder of $Y_2O_3$ about 1 μm in particle size were mixed together in a ratio of 100:1 by weight in a mortar to obtain 2 kg of a mixture. The mixture was treated by hot isostatic pressing at 1250° C. under a pressure of 1,200 kgf/cm$^2$ to prepare a specimen measuring 50 mm in diameter and 70 mm in length. This specimen will be referred to as "Specimen No. 1."

Next, the same Fe-Cr alloy and $Y_2O_3$ as used for Specimen No. 1 were treated in the same weight ratio in an attritor for mechanical alloying for 16 hours or 48 hours. The attritor, which was Model MA-1D manufactured by Mitusi Kakoki Co., Ltd., was filled with 17.5 kg of balls (made of JIS-SUJ-2) with a diameter of about ⅜ inch and operated with its rod stirrer rotated at 290 r.p.m. The powders obtained were then consolidated by hot isostatic pressing in the same manner as in the case of Specimen No. 1. The specimens thus prepared from the powders mechanically alloyed by the attritor for 16 hours and 48 hours will be referred to as No. 2 and No. 3, respectively.

A powder of Fe-Cr alloy containing 15% of Fe and having a mean particle size of 100 μm was consolidated by hot isostatic pressing (under the same condition as in the case of Specimen No. 1) without conducting the mechanical alloying treatment. The specimen obtained will be referred to as No. 4.

Furthermore, a powder of Fe-Cr alloy containing 15% of Fe and having a mean particle size of 100 μm was pulverized in the attritor for 48 hours without adding any $Y_2O_3$ powder thereto. The specimen prepared from the resulting powder will be referred to as No. 5.

Figure 2:
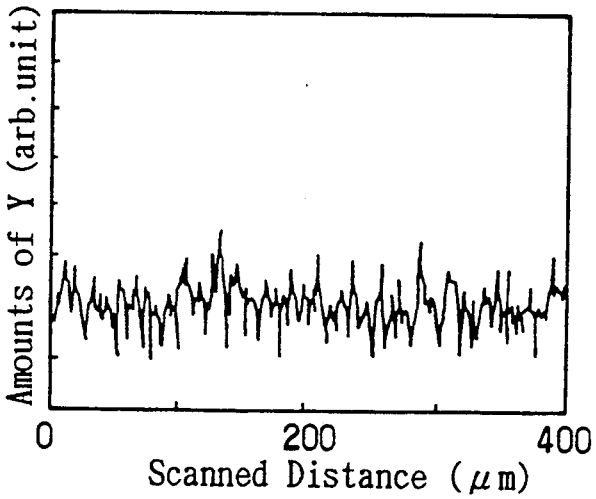
Figure 3:
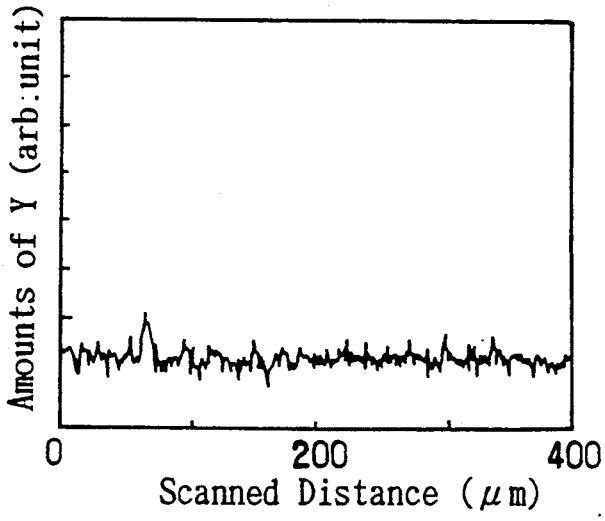

FIGS. 1 to 3 are diagrams showing the state of $Y_2O_3$ as dispersed in Specimens No. 1 to No. 3 and determined by EPMA. FIGS. 1 to 3 correspond to Specimens No. 1 to No. 3, respectively. FIG. 1 shows the oxide still in a mixed state. The oxide is shown as insufficiently dispersed in FIG. 2, and as finely dispersed in FIG. 3.

Next, the specimens were tested for compression at a high temperature by being cyclicly subjected to a compressive load of 0.5 kgf/cm$^2$ by vertical strokes of a ram within an electric furnace at 1350° C. Each specimen was subjected to the compressive load of 0.5 kgf/cm$^2$ for 5 seconds, followed by a load-free period of 5 seconds (1 second of transition from loaded state to unloaded state, 3 seconds of load-free state and 1 second of transition from unloaded state to loaded state), and this cycle was repeated $10^4$ times to determine the resulting amount of deformation (unit: %). This test condition is exceedingly severer than the condition under which the alloy is actually used.

The amount of deformation was calculated from the equation:

$$\text{Amount of compressive deformation } (\%) = (L1 - L2)/L1 \times 100$$

wherein L1 is the length of the specimen before testing, and L2 is the length thereof after testing.

Table 1 shows the mean grain size of the metal matrix of each specimen and the amount of deformation produced by the high-temperature compression test.

TABLE 1

| Specimen No. | Mean grain size (μm) | Amount of deformation (%) |
|---|---|---|
| 1 | 50 | 3.9 |
| 2 | 5 | 1.1 |
| 3 | 5 | Up to 0.1 |
| 4 | 50 | 1.25 |
| 5 | 5 | 3.0 |

Table 1 reveals that Specimen No. 1 deformed markedly which was prepared from the mixture obtained by merely mixing the alloy material with $Y_2O_3$ in a mortar. It is also seen that more than 1% of deformation occurred in Specimen No. 2 wherein the oxide was nor fully dispersed (not finely dispersed) despite the mechanical alloying treatment conducted, or in Specimen No. 4 which was prepared by treating the powder by hot isostatic pressing without mechanical alloying treatment. Specimen No. 5 prepared by merely treating the $Y_2O_3$-free alloy powder in the attritor also deformed markedly.

The amount of deformation can be diminished remarkably only when the powder mixture is fully mechanical-alloyed to finely disperse the $Y_2O_3$ in the matrix metal as is the case with Specimen No. 3.

Table 1 further shows that the mechanical alloying treatment reduced the mean grain size of the matrix metal to about 5 μm (Specimen Nos. 2, 3 and 5). Although it has been desired that the matrix metal be at least about 50 μm in mean grain size to ensure enhanced compressive deformation resistance at high temperatures, the listed result indicates that this resistance can be improved even if the mean grain size of the matrix metal is smaller by fully conducting the mechanical alloying treatment and thereby finely dispersing $Y_2O_3$.

Next, the relationship between the Fe content and the oxidation resistance will be clarified.

Various specimens were prepared by mixing a predetermined amount of $Y_2O_3$ with material powders having varying Fe contents, treating the mixtures in an attritor for mechanical alloying and further treating the resulting mixtures by hot isostatic pressing. A solid cylindrical test piece measuring 8 mm in diameter and 40 mm in length was cut out from each of the specimens, held in a heating furnace (containing atmospheric air) at 1350° C. for 100 hours, then withdrawn from the furnace and surface-treated with an alkali solution and an acid solution to remove the scale. The oxidation reduction ($g/m^2 \cdot hr$) was determined from the resulting change in the weight of the test piece.

The $Y_2O_3$ was used in an amount of 1 part by weight per 100 parts by weight of the material powder, and the mixtures were treated in the attritor under the same condition as previously described for 48 hours (i.e., for a period sufficient to finely disperse the $Y_2O_3$)

Table 2 shows the chemical composition of the specimens and the test result.

TABLE 2

| Specimen No. | Fe (%) | Cr (%) | $Y_2O_3$ (%) | Oxidation reduction ($g/m^2 \cdot hr$) |
|---|---|---|---|---|
| 11 | — | Balance | 1 | 0.5 |
| 12 | 15 | Balance | 1 | 0.7 |
| 13 | 20 | Balance | 1 | 0.9 |
| 14 | 25 | Balance | 1 | 1.3 |
| 15 | 35 | Balance | 1 | 1.9 |

Table 2 reveals that an increase in the Fe content resulted in a greater oxidation reduction, entailing lower oxidation resistance. To obtain satisfactory oxidation resistance at high temperatures of not lower than 1350° C., it is desired that the oxidation reduction rate be no in excess of 1.0 $g/m^2 \cdot hr$ under the above test condition, so that the Fe content should be up to 20 wt. % as previously stated.

Next, various sintered specimens prepared by mechanical alloying (except for Specimen No. 51 which was not so treated) and hot isostatic pressing were tested for high-temperature compressive strength.

The mechanical alloying was carried out under the same condition as already described except the treating time which was 48 hours. The hot isostatic pressing treatment and the high-temperature compression test were conducted by the same procedures as previously stated. Table 3 shows the chemical composition of the specimens and the test result. Specimen Nos. 21 to 41 are sintered alloys of the invention having $Y_2O_3$ finely dispersed in the matrix metal. Specimen Nos. 51 to 55 are comparative sintered alloys.

TABLE 3

| Specimen No. | Composition | $Y_2O_3$ (%) | Deformation (%) |
|---|---|---|---|
| 21 | 100% Cr | 0.3 | 0.15 |
| 22 | 100% Cr | 0.6 | Up to 0.1 |
| 23 | 100% Cr | 1.5 | Up to 0.1 |
| 24 | 5% Fe, bal. Cr | 1.0 | Up to 0.1 |
| 25 | 15% Fe, bal. Cr | 1.0 | Up to 0.1 |
| 26 | 15% Fe, bal. Cr | 0.3 | 0.15 |
| 27 | 15% Fe, bal. Cr | 0.9 | Up to 0.1 |
| 28 | 15% Fe, bal. Cr | 1.8 | 0.17 |
| 29 | 15% Fe, 1% Al, 1% Nb, bal. Cr | 1.0 | Up to 0.1 |
| 30 | 15% Fe, 1% Al, 1% Nb, bal. Cr | 1.8 | 0.16 |
| 31 | 5% Al, bal. Cr | 1.0 | Up to 0.1 |
| 32 | 5% Mo, bal. Cr | 1.0 | Up to 0.1 |
| 33 | 5% W, bal. Cr | 1.0 | Up to 0.1 |
| 34 | 5% Nb, bal. Cr | 1.0 | Up to 0.1 |
| 35 | 5% Ta, bal. Cr | 1.0 | Up to 0.1 |
| 36 | 5% Hf, bal. Cr | 1.0 | Up to 0.1 |
| 37 | 5% Al-Ti, bal. Cr | 1.0 | Up to 0.1 |
| 38 | 1% Ti, bal. Cr | 1.0 | Up to 0.1 |
| 39 | 1% Ti, 10% Fe, bal. Cr | 1.0 | Up to 0.1 |
| 40 | 1% Ti, 5% Mo, bal. Cr | 1.0 | Up to 0.1 |
| 41 | 1% Ti, 10% Fe, 5% Al, bal. Cr | 1.0 | Up to 0.1 |
| 51 | 100% Cr | — | 2.50 |
| 52 | 100% Cr | 0.1 | 0.34 |
| 53 | 35% Fe, bal. Cr | 1.0 | Up to 0.1 |
| 54 | 5% Fe, bal. Cr | — | 1.50 |
| 55 | 15% Fe, bal. Cr | — | 1.25 |

The result given in Table 3 shows that Specimens No. 21 to No. 41 embodying the present invention are up to 0.17% in compressive deformation and retain exceedingly high compressive deformation resistance even if used at high temperatures of at least 1350° C.

Specimen No. 51 was not treated by mechanical alloying, is free from $Y_2O_3$ and is therefore very great in the amount of compressive deformation. Specimen No. 52 has a low $Y_2O_3$ content, is not fully given the effect of finely dispersed $Y_2O_3$ and is as great as 0.34% in compressive deformation. Although having excellent high-temperature compressive strength, Specimen No. 53 contains as much as 35% of Fe, is low in oxidation resistance as previously stated and is therefore outside the scope of the invention. Specimens No. 54 and No. 55, which are free from $Y_2O_3$, exhibited marked compressive deformation.

The sintered alloy of the present invention has very high oxidation resistance and excellent high-temperature compressive strength, is therefore useful for making skid buttons for use in heating furnaces of the walking beam conveyor type of which these characteristics are required and has the advantage of assuring improved durability and diminished labor for maintenance.

The alloy of the present invention is of course usable for applications, other than skid buttons, of which oxidation resistance and compressive strength are required for use at high temperatures.

What is claimed is:

1. An oxide-dispersion-strengthened heat-resistant-sintered alloy including 0.2 to 2.0% by weight of $Y_2O_3$, wherein the $Y_2O_3$ is uniformly dispersed in a metal matrix by a mechanical alloying process, as discrete particles with a mean particle size of up to 0.1 μm, the metal being selected from the group consisting of:

(a) a metal consisting essentially of more than 0% to up to 20% of Fe, and the balance substantially Cr;

(b) a metal consisting essentially of 0% to up to 20% of Fe, at least one member selected from the group consisting of Al, Mo, W, Nb, Ta, Hf and Al-Ti in a total amount of more than 0% to up to 10%, and the balance substantially Cr;

(c) a metal consisting essentially of more than 0% to up to 20% of Fe, 0.1 to 2.0% of Ti, and the balance substantially Cr; and (d) a metal consisting essentially of more than 0% to up to 20% of Fe, 0.1 to 2.0% of Ti, at least one member selected from the group consisting of Al, Mo, W, Nb, Ta, Hf and Al-Ti in a total amount of more than 0% to up to 10%, and the balance substantially Cr;

wherein said mechanical alloying process comprises forcibly finely dispersing said $Y_2O_3$ into said metal by means of a high energy ball mill.

2. A sintered alloy as defined in claim 1 wherein the matrix metal contains up to 3% of Si and up to 3% of Mn as impurities.

* * * * *